US005083998A

United States Patent [19]

Carter

[11] Patent Number: 5,083,998

[45] Date of Patent: Jan. 28, 1992

[54] TRANSFER MEANS FOR FOLDED SHEET MATERIAL

[76] Inventor: Christopher P. Carter, 14118 SE. Stark, Portland, Oreg. 97223

[21] Appl. No.: 529,311

[22] Filed: May 29, 1990

[51] Int. Cl.[5] ..... B65H 45/16; B65H 29/40; B65H 29/12

[52] U.S. Cl. ..... 493/427; 493/416; 271/187; 271/315

[58] Field of Search ..... 493/416, 426, 427, 435, 493/444, 445; 271/187, 315

[56] References Cited

U.S. PATENT DOCUMENTS

| | | | |
|---|---|---|---|
| 308,214 | 11/1884 | Stonemetz | 493/445 |
| 1,766,083 | 6/1930 | Richter | 271/187 |
| 1,905,687 | 4/1933 | Crafts | 271/315 |
| 1,949,152 | 2/1934 | Frankboner | 271/315 |
| 2,026,162 | 12/1935 | DeManna | 271/315 |
| 2,583,746 | 1/1952 | Peterson | 270/45 |
| 3,931,963 | 1/1976 | Bewersdorf | 270/61 |
| 4,279,410 | 7/1981 | Bolza-Schunemann | 493/427 |
| 4,361,318 | 11/1982 | Storb | 271/202 |
| 4,427,405 | 1/1984 | Hoshi | 493/444 |
| 4,487,408 | 12/1984 | Fischer | 271/187 |
| 4,519,594 | 5/1985 | Weschenfelder et al. | 270/20.1 |
| 4,524,961 | 6/1985 | Suzuki | 270/4 |
| 4,569,672 | 2/1986 | Marion et al. | 493/444 |
| 4,638,993 | 1/1987 | Granzow et al. | 271/187 |
| 4,840,609 | 6/1989 | Jones et al. | 493/444 |
| 4,861,019 | 8/1989 | Michalik | 271/315 |

*Primary Examiner*—William E. Terrell
*Attorney, Agent, or Firm*—Kolisch, Hartwell, Dickinson, McCormack & Heuser

[57] ABSTRACT

Sheet folding apparatus comprising half fold rolls folding in half sheet material fed to a delivery fan. Material is stripped from the delivery fan and drops to a conveyor. Multiple belts extending from one of the half fold rolls and past the delivery fan guide and convey material to the delivery fan in a manner minimizing jamming at the delivery fan.

7 Claims, 2 Drawing Sheets

TRANSFER MEANS FOR FOLDED SHEET MATERIAL

This invention relates to sheet transfer apparatus, and more particularly to apparatus that may be employed, for instance, in a rotary printing press, to transfer folded sheets from a folding device to place the sheets in successive peripheral pockets of a so-called delivery fan.

Describing a typical rotary press which is available commercially today, a web of paper from a paper roll is trained over various rolls with printing performed as the paper passes over the rolls. The paper then travels over what is known as a tucking cylinder, where lengths of paper cut from the web are advanced through folding rolls or rollers which function to fold the sheets whereby opposite ends of a sheet are brought together (the sheets are folded in half). The folded sheets are then directed to a rotatable delivery fan which has pockets distributed circumferentially about it perimeter. Successive sheets from the folding rolls become lodged in successive pockets on the periphery of the delivery fan. As the fan rotates, the sheets are stripped from the pockets to become layered in overlapped relationship on an out-going conveyor.

Problems have been experienced in transferring sheets from the folding rolls to successive pockets on the delivery fan. Because of a lack of positive and proper control over the moving sheets, they have tended to become disarrayed, with jamming of the machine. When jamming occurs, time is lost in removing the jammed material. Further, removing jammed material can be hazardous.

This invention contemplates a belt system which functions to channel material into successive pockets of the delivery fan. The belts are moved under power, and thus are effective to produce a positive conveying action. The belts have flexibility and yieldability, but firmly guide the sheet material into the desired pockets. Following the invention, down time, by reason of jamming, is substantially reduced. Furthermore, it is possible to run the equipment at substantially faster speeds then previously possible.

An object of the invention, therefore, is to provide improved transfer means for transferring sheet material into the external pockets of a rotatable pocketed member such as a delivery fan.

More particularly, an object is to provide transfer belts that extend from a folding device and thence across the periphery of a rotatable pocketed member, effective to produce controlled flow of sheet material from the folding device into pockets on the pocketed member.

Figure 1:
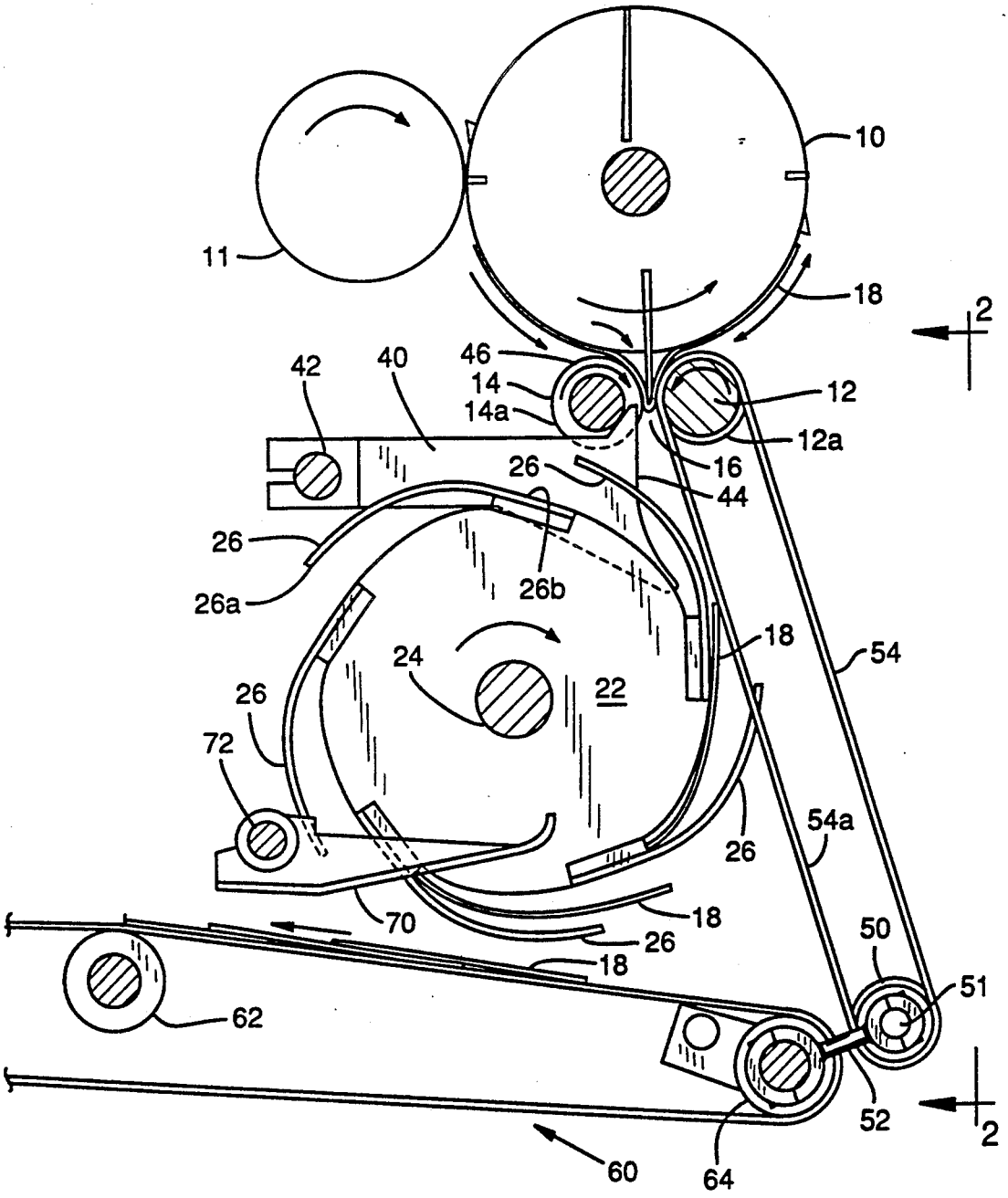
Figure 2:
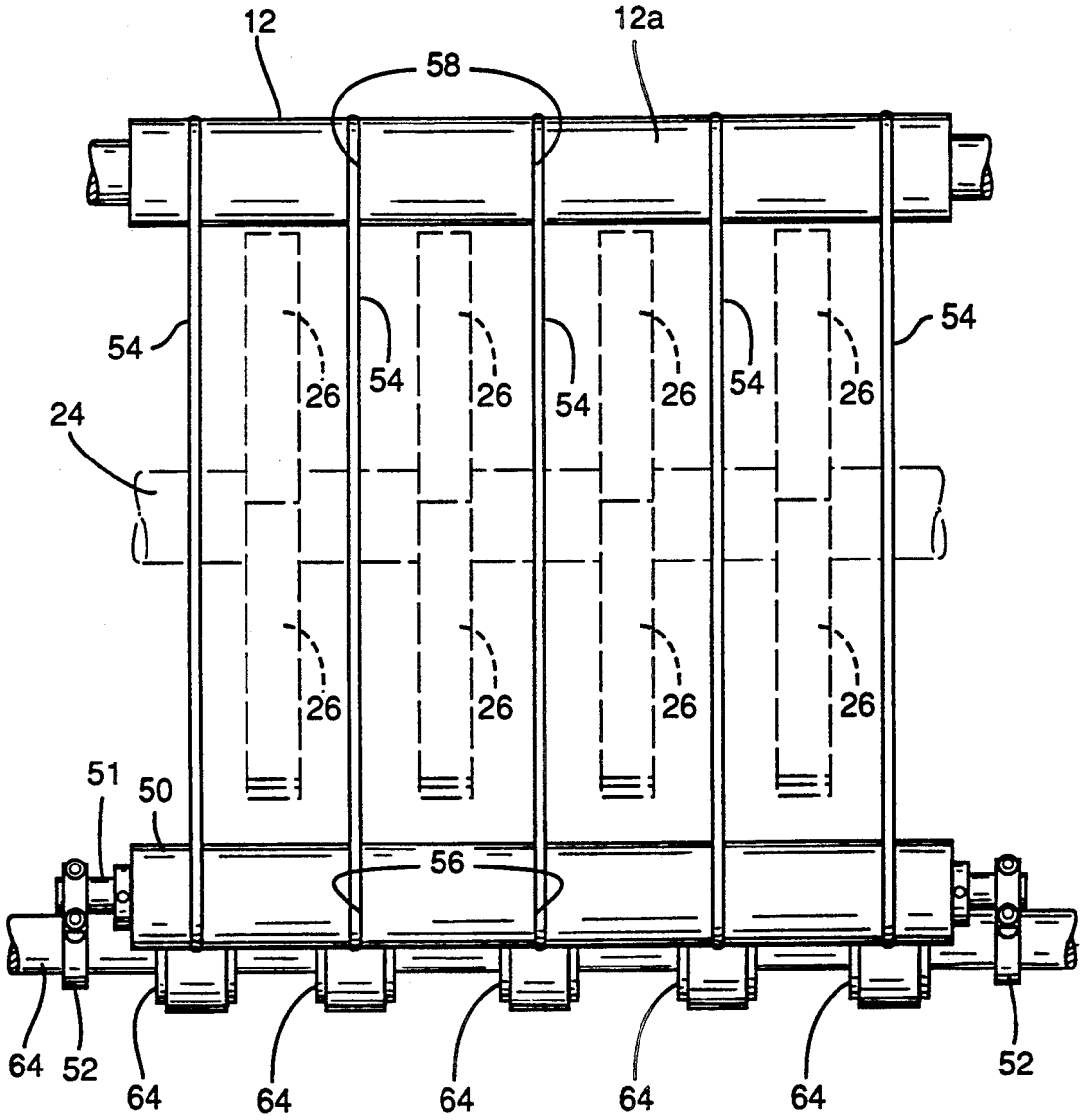

Various other objects and advantages are attained by the invention, which is described hereinbelow in conjunction with the accompanying drawings, wherein:

FIG. 1 is a cross-sectional view, illustrating a tucking cylinder, half fold rolls below this cylinder, and a rotatable pocketed member or delivery fan disposed below the half fold rolls operable to receive material and thence discharge such material in overlapped relation on an out-going conveyor; and FIG. 2 is an elevational view taken generally along the line 2—2 in FIG. 1.

Illustrated in the drawings are portions of a rotary printing press and more particularly, those portions of a press where cut to length sheets are folded end-to-end, with successive sheets then transferred into successive pockets of a delivery fan thence to be laid down in overlapped relation on an out-going conveyor.

Referring to FIG. 1, indicated at 10 and in simplified form is a so-called tucking cylinder. The tucking cylinder is rotatably mounted in the frame of the press. Adjacent the tucking cylinder is a knife cylinder 11. With rotation of the knife cylinder, a knife on the cylinder cuts lengths of sheet from the continuous web being processed. An end of a cut length of paper sheet is suitably anchored to a portion of the periphery of the tucking cylinder, and the tucking cylinder as it rotates under power positions a portion of the sheet which is intermediate the ends of the sheet directly above a region midway between a pair of half fold rolls or folding rolls located below the tucking cylinder. These rolls have been given reference numbers 12 and 14. Roll 12, for the most part, and referring to FIG. 2, is bounded by a cylindrical surface 12*a*. So also is half fold roll 14 bounded by a cylindrical surface 14*a*. The axes of rolls 12, 14 are parallel, and as can be seen in FIG. 1, the rolls are mounted with a small space 16 left between the surfaces of the rolls. When folding material, roll 14 backs up roll 12, and roll 12 backs up roll 14.

A sheet on the tucking cylinder is shown at 18. With the mid-region of a sheet on the tucking above space 16, a blade on the tucking cylinder is actuated to extend, causing a reverse bend to be introduced into the sheet and to cause this bend region to be inserted into space 16. Rolls 12 and 14 are rotated under power, so that with the sheet so inserted and with continued rotation of the rolls, the sheet is drawn downwardly to be entirely advanced between the rolls 12, 14 with the sheet on leaving the rolls being folded over on itself. After positioning a mid-region of the sheet between the rolls, the blade on the tucking cylinder is retracted. Another sheet grabbed by the tucking cylinder is then positioned, in the same manner as discussed in connection with sheet 18.

A rotatable pocketed member, i.e., a delivery fan, is rotatably mounted on the frame of the press below half fold rolls 12, 14. The member is mounted with its axis paralleling the axes of rolls 12, 14.

Describing the pocketed member in more detail, such includes a center shaft 24. Suitably secured in fixed positions on the shaft, and appearing at intervals along the length of the shaft, are disk members, such as disk member 22. The disk members and shaft 24 collectively provide a core in the pocketed member Each disk member, and as shown in FIG. 1, has multiple, i.e., five elongate curved tines 26 secured thereto, with these tines equally circumferentially spaced about the core.

Each tine on a disk member is aligned, in a direction extending axially of the pocketed member, with like tines on the other disk members. Each tine and the tines aligned therewith collectively define a pocket on the pocketed member. Thus, the delivery fan or pocketed member herein specifically disclosed has five such pockets distributed circumferentially about the member.

During use, the delivery fan is rotated in a clockwise direction as viewed in FIG. 1. Each tine is secured at its butt end 26*b* to a disk member, and thence extends in a circumferential direction to a distal or unsupported end 26*a*. Thus the pockets defined by the tines have open mouths which face opposite the direction of travel of the delivery fan.

Interspersed with the disks 22, and located, for the most part, above the disks, are multiple guide elements, such as the guide element shown at 40. These have one set of ends secured to a shaft 42 suitably mounted in the frame of the press. Bounding opposite ends are guide edges such as edge 44 extending generally from feed roll 14 downwardly to the level of the disks below it. These guide edges guide folded sheet material as it travels downwardly to be lodged in one of the pockets. Roll 14 is provided at intervals along its length with annular grooves such as the one shown at 46. These grooves receive upper portions of the guide elements.

Shown at 50 is a belt-training roll. The roll is rotably supported on a shaft 51. Ends of the shaft are supported in mountings 52.

Trained over roll 50 are plurality of endless round belts 54. The roll may contain grooves 56 which receive the belts where they travel about the roll. Upper extremities of the belts are trained over half fold roll 12. Again, this half fold roll may contain groove such as groove 58 receiving the belts where they are trained about the half fold roll. The belts as so positioned have runs indicated at 54*a* which extend downwardly past the pocket member to a region below the pocket member.

The delivery fan receives folded material in a pocket and on further rotation this material is dislodged from the pocket to be layered onto an off-bearing conveyor. The conveyor is illustrated at 60, and comprises conventional plural conveyor belts supported by rolls extending transversely of these belts, as exemplified by rolls 62, 64.

Dislodging folded material from a pocket on the delivery fan are stripping fingers, such as the one shown as 70. A stripping finger may be provided between each of the adjacent disks 26 of the delivery fan. The fingers have butt ends suitably secured to a shaft 72 which is mounted at its ends in the frame of the press.

Describing how the apparatus operates, cut sheet material supported on the tucking cylinder is advanced between the half fold rolls to be folded in half by a fold prepared midway between the ends of the sheet. This sheet material on leaving the half fold rolls is pulled downwardly by runs 54*a* of the belts, while also guided by guide edges 44. Successive folded sheets fill successive pockets on the delivery fan. The sheets are then stripped from the delivery fan with the stripping fingers to be layered out on conveyor 60 normally, with an overlapped relationship.

The powered movement of belts 50 has been observed to essentially eliminate jamming at the delivery fan. If jamming does occur, it is a relatively easy matter to remove the jammed material with the belts flexing laterally to permit the hands to be moved behind them.

Urethane belting may be used for belts 54. A continuous belt trained about rolls 12, 50 is readily prepared by cutting a proper length of belting, placing such about the rolls, and then heating and splicing opposite ends of the length of belting.

While an embodiment of the invention has been specifically described, obviously, modifications and variations are possible without departing from the invention.

It is claimed and desired to secure by Letters Patent:

1. Sheet folding apparatus comprising:

sheet folding means including a rotatable power-driven folding roll and back up means opposite the roll with a space between the roll and back up means for sheet material to travel through on being folded.

a belt-training roll spaced from the power-driven roll and having an axis paralleling the axis of the power-driven roll, a belt trained over the power-driven roll and belt-training roll including a run which extends between the rolls and that moves from the power-driven roll to the belt-training roll, a rotatable member disposed with the periphery of the member to one side of said run, the rotatable member being rotatable about an axis paralleling the belt-training roll axis, the rotatable member having pocket-defining means defining at least one pocket on the periphery of the member for receiving folded sheet material, the pocket-defining means moving in a path with rotation of the rotatable member, the path of the pocket-defining means overlapping said run of the belt-training roll when viewing the belt run and pocket-defining means from a direction paralleling the axis of the rotatable member, said run of said belt channeling sheet material leaving the folding roll whereby such material is fed into the pocket on said rotatable member.

2. The folding apparatus of claim 1, which further includes a back guide with a guide surface disposed opposite said run interposed between said back up means and said rotatable member.

3. The folding apparatus of claim 1, wherein said pocket-defining means defines plural pockets distributed circumferentially about the rotatable member, each receiving pocket folded sheet material channeled thereto by said run.

4. The folding apparatus of claim 1, wherein said pocket-defining means comprises, for one pocket, plural elongate tines spaced along the axis of the rotatable member, the tines being aligned in a direction extending axially of the member and collectively defining an open mouth for the pocket that faces a direction which is opposite the direction of travel of the periphery of the member, said run of the belt being interspersed with a pair of said tines.

5. Sheet folding apparatus comprising:

a pair of rotatable folding rolls disposed opposite each other and spaced from each other to enable the passage therebetween of folded sheet material, a rotatable belt-training roll with an axis paralleling the axes of said folding rolls and spaced a distance from the folding rolls, multiple belts spaced laterally one from another trained over one of said folding rolls and over said belt-training roll and said belts having parallel runs that travel in a direction extending away from said one folding roll, and a rotatable member disposed with the periphery of the member adjacent said runs of said belts and with its axis paralleling the axis of the belt-training roll, said rotatable member including a core and a series of tines mounted on said core at the periphery of the member, the tines being aligned in a direction extending axially of the member and the tines collectively forming a pocket for the reception of sheet material, said runs of said belts being interspersed with said tines, said runs of said belts channeling folded material into said pocket, the tines moving in paths with rotation of the rotatable member and the runs of the belts and the paths of the tines overlapping when viewing the belt runs from a direction paralleling the axis of the rotatable member.

6. The folding means of claim 5, wherein said one folding roll has annular grooves extending thereabout distributed along the length of the roll and said belts where trained over said one folding roll are lodged within said grooves.

7. The sheet folding means of claim 5, which further includes back guide elements intermediate the other of said folding rolls and said rotatable member, said elements having guide surfaces spaced from said belt runs and cooperating with said belt runs to form a channel extending from the folding rolls to the rotatable member.

* * * * *